US005407620A

United States Patent [19]

Burchette et al.

[11] Patent Number: 5,407,620

[45] Date of Patent: Apr. 18, 1995

[54] ONE-STEP PROCESS FOR THE MANUFACTURE OF TWISTED NYLON YARN

[75] Inventors: Donald J. Burchette, Candler, N.C.; Marco A. Luzzatti, Greenville, S.C.; Roger H. Fink; Michael A. Davis, both of Asheville, N.C.

[73] Assignee: BASF Corporation, Parsippany, N.J.

[21] Appl. No.: 81,531

[22] Filed: Jun. 23, 1993

[51] Int. Cl.[6] ..... D01D 5/22; D02G 1/02

[52] U.S. Cl. ..... 264/103; 57/284; 57/334; 57/336; 57/337; 264/168; 264/211.12

[58] Field of Search ..... 264/103, 210.8, 211.12, 264/290.5, 168; 57/284, 287, 288, 310, 334, 336, 337

[56] References Cited

U.S. PATENT DOCUMENTS

| | | | |
|---|---|---|---|
| 3,994,121 | 11/1976 | Adams | 264/103 X |
| 3,996,324 | 12/1976 | Landenberger et al. | 264/103 |
| 4,019,311 | 4/1977 | Schippers | 264/103 X |
| 4,726,180 | 2/1988 | Naylor et al. | 57/334 |

FOREIGN PATENT DOCUMENTS 47-36457 9/1972 Japan .

*Primary Examiner*—Leo B. Tentoni

[57] ABSTRACT

Described is a new one-step process for the manufacture of twisted nylon yarn, which simultaneously spins, draws and false-twists a nylon yarn. The process operates with a spinning speed of more than 3000 m/min.

13 Claims, 1 Drawing Sheet

ONE-STEP PROCESS FOR THE MANUFACTURE OF TWISTED NYLON YARN

FIELD OF THE INVENTION

The present invention is directed to a one-step process for the manufacture of a twisted nylon yarn, in particular it is directed to a process which simultaneously spins, draws and false-twists a nylon yarn.

BACKGROUND OF THE INVENTION

Twisted or torque yarns are currently produced using a two-step process. Undrawn feeder yarn is spun in the first step using conventional spinning and winding equipment. The second step involves producing the final torque yarn by drawing and false-twisting of the feeder yarn on a separate piece of equipment. The predominant method for putting twist in the torque yarn is the friction-false-twist method. The draw-twist step typically occurs at 1000 meters/minute. The false-twisting is a four-stage process consisting of:

1) twisting a continuous filament yarn;
2) heat-setting the yarn in a twisted configuration;
3) cooling the yarn prior to releasing the twist; and
4) untwisting the yarn in the opposite direction of the original twist.

Twisting of the yarn is accomplished by passing it over a moving surface with frictional characteristics high enough to rotate the yarn.

The JP 72036457 discloses a process for the manufacture of twisted yarn by simultaneously spinning, holding, twisting and drawing the yarn. The twisting occurs on a rotating cylinder at a temperature within the range from the glass transition point to a temperature 20° C. below the polymer melting point. The drawing occurs with a drawing roll after the twisting. The highest disclosed spinning speed is 1,000 m/min.

U.S. Pat. No. 3,996,324 discloses a high speed single step process for producing pre-oriented synthetic yarn by using a pigtail guide and a horseshoe guide to produce an untwisted yarn in ribbon form and by taking up the yarn at a speed of from 2500 to 6000 meters per minute.

U.S. Pat. No. 4,726,180 discloses a false twist apparatus comprising a rotating cylinder with guides to set the yarn in a helix path around the cylinder which will enable yarns to be processed at low twist levels with consistency and good process control. The reference does not disclose a one step process for the manufacture of twisted yarn.

Object of the present invention was to provide a one step process for the manufacture of twisted nylon yarns which simultaneously spins, draws and false-twists a nylon yarn at winding speeds above 3000 m/min.

SUMMARY OF THE INVENTION

The object of the present invention could be achieved by a one-step process for the manufacture of twisted nylon yarns comprising:

(a) melt-spinning a nylon yarn at a speed of more than 3000 m/min;
(b) applying heat to the yarn;
(c) cooling the yarn;
(d) false twisting; and
(e) winding the yarn.

DETAILED DESCRIPTION OF THE INVENTION

Figure 1:
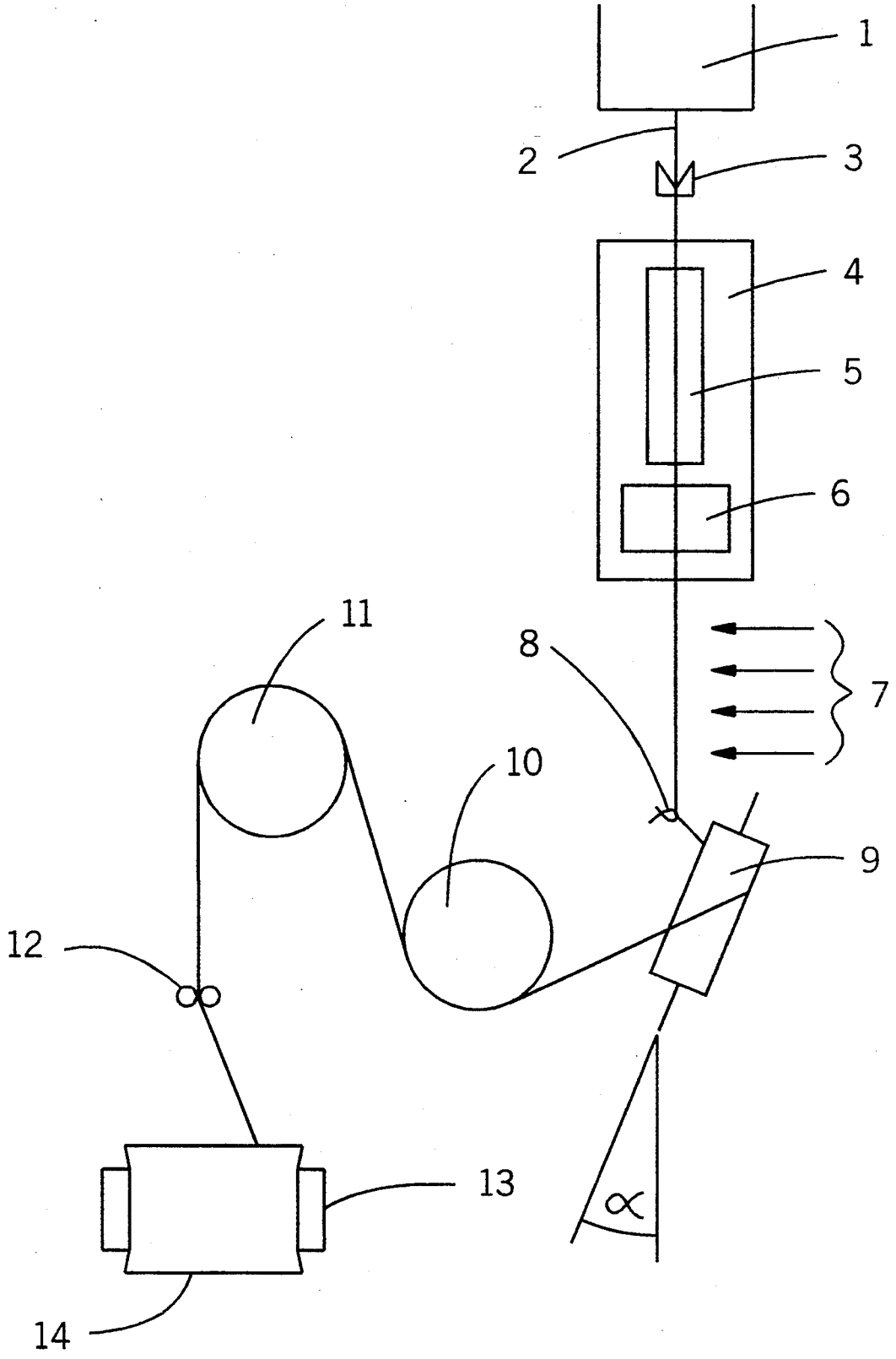
FIG. 1 is a schematic view of an apparatus suitable for the manufacture of twisted nylon yarns in a one-step process.

The process for the manufacture of twisted nylon yarns of the present invention is described with reference to FIG. 1.

FIG. 1 shows a spinnerette assembly (1), from where the nylon fiber or fibers are combined to a yarn (2), the yarn is directed through a filament guide (3) to the heating zone (4) with the heating plates (5) and (6). The yarn is cooled in the cooling zone (7) and directed through the filament guide (8) to the rotating cylinder (9), which is positioned in an angle alpha to the direction of the yarn, and over the two godets (10) and (11), to a guiding eyelet (12), below which the yarn is moved back and forth by a traversing device, which is not shown. The yarn is taken up on a bobbin (13) to form a yarn package (14).

The process of the present invention is applicable for all fiber forming polymers, but preferred are polyamides and copolyamides.

Polyamides and copolyamides are well known by the general term "nylon" and are long chain synthetic polymers containing amide (—CO—NH—) linkages along the main polymer chain. Suitable fiber-forming or melt spinnable polyamides of interest for this invention include those which are obtained by the polymerization of a lactam or an amino acid, or those polymers formed by the condensation of a diamine and dicarboxylic acid. Typical polyamides include nylon 6, nylon 6/6, nylon 6/10, nylon 6/12, nylon 6T, nylon 11, nylon 12 and copolymers thereof or mixtures thereof. Polyamides can also be copolymers of nylon 6 or nylon 6/6 and a nylon salt obtained by reacting a dicarboxylic acid component such as terephthalic acid adipic acid or sebacic acid with a diamine such as hexamethylene diamine, metha xylene diamine, or 1,4-bisaminomethyl cyclohexane. Preferred are poly-epsilon-caprolactam (nylon 6) and polyhexamethylene adipamide (nylon 6/6). Most preferred is nylon 6.

In step (a) of the present invention the nylon is molten for example in an extruder at a temperature of from about 260° to about 350° C. and the resulting melt is directed to the spin pack assembly (1), where it is spun into a fiber or a bundle of fibers, which are combined to a multifilament yarn (2). Therefore the process is suitable for single and multifilament yarns.

In step (b) heat is applied to the yarn in the heating zone (4). Heat is needed to deform and heatset the yarn in a twisted configuration, because twisting of the yarn occurs in this heating zone (4). Heat is needed to deform and heatset the yarn in a twisted configuration, because twisting of the yarn occurs in this heating zone caused by the false twisting device. Heat is also needed for the crystallization and orientation of the yarn in a one-step process.

Various devices and methods for heating the yarn are suitable like electrical steam, vapor phase, laser, infrared and microwave devices and the like.

Preferred is electrical and laser.

The heat is applied to the yarn by a non-contact heater like radiation or by a contact heater like heating plate consisting of metal, ceramic glass, plasma coating and the like.

Preferred is a contact heater with a ceramic surface.

The temperature in the heating zone is from about 150° to about 800° C., preferable from about 200° to about 600° C. and most preferred from about 250° to about 450° C.

In step (c) the yarn is cooled in the cooling zone (7). A cooling zone is needed between the heating device and the twisting device to "freeze" or set the twist in the yarn in order to prevent the twist deformation from being taken out of the yarn when it is untwisted.

Cooling of the yarn may be performed by non contact or by surface contact. Air is suitable for non-contact cooling and has a temperature of from about 15° to about 30° C., preferably from about 18° to about 25° C.

More effective than air is cooling the yarn by surface contact. Suitable surfaces are metal, ceramic, plasma coating and the like. The temperatures are from about 18° to about 22° C.

Preferred is surface contact.

In step (d) the yarn is false twisted. Any false-twist device like a belt, disc, cylinder and the like, that operates independently of the winding speed could be used in this one-step process. Preferred for the process of the present invention is a rotating cylinder. The cylinder may run in both clockwise and counter-clockwise directions so that "S" and "Z" shaped yarns could be made with the same cylinder.

The size (length and diameter), rotating speed, and surface of the cylinder could vary depending on winding speed and torque requirements. For the process of the present invention the cylinder is operated with a rotating speed of about 10,000 to about 50,000 revolutions per minute preferably from about 20,000 to about 45,000 revolutions per minute, most preferred from about 25,000 to about 35,000 revolutions per minute.

The cylinder has a surface coated with ceramic, diamond, polyurethane, neoprene, rubber, plasma and the like. A preferred coating is ceramic.

The cylinder is tilted with an angle alpha of from about 0° to 10°, preferably 0° to 5° from the direction of the yarn, which is the direction between the spinnerette assembly (1) and the guide (8) in FIG. 1.

Caused by the rotation of the cylinder the yarn is twisted in the heating zone (4). In the following cooling zone (7) the twist is set before the yarn touches the cylinder (9), so that the rotation of the cylinder is transmitted to the yarn.

In step (e) the yarn is wound up with a wind up speed of above 3000 m/min, in particular, from about 3000 to about 5000 m/min, preferably from about 3500 to about 4500 m/min and most preferred from about 4000 to about 4500 m/min.

The process of the present invention does not need an extra drawing step after the false twist step (d) because drawing occurs simultaneously with the false twisting in the heating zone (4). The drawing ratio is from about 1.00 to about 2.00, preferably from about 1.2 to about 1.4.

Another optional step in the process of the present invention may be a finishing step.

The yarn produced by the process of the present invention has from about 30 to about 150 twists/m, preferably from about 60 to about 90 twists/m.

The yarn has deniers of from about 5 to about 50.

EXAMPLE

Nylon 6 with a relative viscosity of 2.40 (1% solution in 90% formic acid at 25° C.) is melted and metered through a spinnerette (1) to form a single filament yarn (2). The spinnerette consists of a single hole with a 0.250 mm diameter. The yarn is cooled in a quench box, not shown, and directed through a guide (3) to the heating zone (4). The first section of the heating zone (5) is heated to 200 deg. C and the final section (6) is heated to 525 deg. C.

The yarn (2) is drawn and heat set while in the heat zone in a twisted stage. The yarn is then cooled by ambient air at 20 deg. C. and guided around the rotating cylinder (9) which is rotating in a clock-wise or a counter-clock-wise direction at 22,500 rpm. Yarn is detwisted between the rotating cylinder and the first godet (10). Yarn then is guided around the godets (10) and (11) to a guide (12) and finally to the bobbin (13) to form a package.

A 15 denier monofilament with a 4.9 grams per denier, 68 percent elongation and an Apparent Twist per Inch of 40 is formed which is suitable for hosiery.

What is claimed is:

1. A one-step process for the manufacture of twisted nylon yarns consisting essentially of:
   (a) melt-spinning a nylon yarn;
   (b) applying heat to the yarn in a heating zone;
   (c) cooling the yarn;
   (d) false twisting the yarn;
   (e) and winding the yarn at a speed of more than 3000 m/min.

2. The process according to claim 1, wherein the speed is from about 3500 m/min. to about 5000 m/min.

3. The process according to claim 1, wherein the speed is from about 3500 m/min to about 4500 m/min.

4. The process according to claim 1, wherein heat is applied at a temperature of from about 150° to about 800° C.

5. The process according to claim 1, wherein heat is applied at a temperature of from about 200° to about 600° C.

6. The process according to claim 1, wherein heat is applied through contact of the yarn with a heater.

7. The process according to claim 1, wherein the false twisting is performed with a device selected from the group consisting of a belt, disc, cylinder and a combination thereof.

8. The process according to claim 7, wherein the false twisting is performed with a cylinder.

9. The process according to claim 8, wherein the cylinder is tilted at an angle of from about 0° to 10° from the direction of the yarn.

10. The process according to claim 8, wherein the cylinder rotates approximately 10,000 to 50,000 revolutions per minute.

11. The process according to claim 8, wherein the cylinder rotates approximately 20,000 to 45,000 revolutions per minute.

12. The process according to claim 8, wherein the cylinder rotates counter-clockwise approximately 10,000 to 50,000 revolutions per minute.

13. The process according to claim 1, further comprising a finishing step.

* * * * *